US007669429B2

(12) United States Patent
Bassler, Sr.

(10) Patent No.: US 7,669,429 B2
(45) Date of Patent: Mar. 2, 2010

(54) RAPID FOOD CHILLER

(76) Inventor: G. Scott Bassler, Sr., 1613 Brian St., Lebanon, TN (US) 37087

( * ) Notice: Subject to any disclaimer, the term of this patent is extended or adjusted under 35 U.S.C. 154(b) by 172 days.

(21) Appl. No.: 11/655,725

(22) Filed: Jan. 19, 2007

(65) Prior Publication Data

US 2007/0169489 A1 Jul. 26, 2007

Related U.S. Application Data

(60) Provisional application No. 60/760,215, filed on Jan. 19, 2006.

(51) Int. Cl.
*F17C 7/04* (2006.01)

(52) U.S. Cl. ..... 62/48.1

(58) Field of Classification Search ..... 62/276, 62/446, 458, 64, 373, 376
See application file for complete search history.

(56) References Cited

U.S. PATENT DOCUMENTS 2,618,134 A * 11/1952 Kaufman ..... 62/64
5,388,429 A * 2/1995 Shackelford et al. ..... 62/446
5,423,191 A * 6/1995 Bennett ..... 62/201
5,927,092 A 7/1999 Kushen et al.
6,477,855 B1 * 11/2002 Findley et al. ..... 62/434
6,722,150 B1 4/2004 Carr et al.
2004/0006997 A1 1/2004 Clark et al.

FOREIGN PATENT DOCUMENTS

JP 08121952 A 5/1996
WO 2007084620 A2 7/2007

* cited by examiner

*Primary Examiner*—Melvin Jones
(74) *Attorney, Agent, or Firm*—Scheinberg & Griner LLP.

(57) ABSTRACT

An improved method and apparatus for rapidly cooling prepared food uses a novel combination of cold fluid recirculation and vibration to rapidly cool prepared food in a manner that is cost-effective and easy to practice. One embodiment of an improved rapid food chiller includes a tank for holding ice water or another cooling fluid, baskets for holding standard restaurant pans containing prepared food, a pump for circulating the cooling fluid around the outside of the restaurant pans, and a vibrator for vibrating the cooling fluid and the prepared food.

17 Claims, 5 Drawing Sheets

RAPID FOOD CHILLER

This application claims priority from U.S. Provisional App. No. 60/760,215 filed Jan. 19, 2006, which is hereby incorporated by reference.

TECHNICAL FIELD OF THE INVENTION

The present invention relates to food refrigeration units and, in particular, to a refrigeration unit designed to rapidly cool food from cooking temperature to 40° F.

BACKGROUND AND SUMMARY OF THE INVENTION

In the hospitality/food industry, prepared foods often need to be stored for transportation or later use. Restaurants and other large-scale food service operations often prepare dishes in advance and then refrigerate the food so that it can be reheated and served at a later time. This practice, referred to as "cook and chill," helps reduce costs associated with cooking and food preparation while also prolonging the storage life of the food.

The cooked food is typically stored and transported in rectangular, stainless steel pans, commonly known as steam pans or hotel pans. These food pans are of a standard size known to the food industry. These pans ordinarily have a flange or horizontal lip extending around the circumference of the open pan top to hold the pan in a steam or buffet table and/or to offer a convenient lifting and carrying point. The standard size hotel pan is approximately 12.8"×20.8" (L×W), with other standard sizes referred to as half size, quarter size, third size, etc. FIG. 1 shows a standard hotel pan 10 and lid 12. Standard pans are available in various depths, for example 2, 4, or 6 inches deep.

A problem with the "cook and chill" method is that warm food can serve as a breeding ground for bacteria which can cause food poisoning. Because bacterial growth is inhibited at low temperatures, it is important to rapidly chill the cooked food prior to refrigerated storage in order to minimize the risk of human illness. For this reason, for more than 30 years, most health regulations have required that food prepared for later use be cooled from cooking temperature to 40 degrees Fahrenheit or below within certain minimal amounts of time. For example, the 2005 FDA Food Code recommends that hot food be cooled from 140° to 70° F. within two hours, and cooled from 70° to 41° F. within six hours. Potentially hazardous foods must be cooled even faster.

Unfortunately, most commercially available refrigerators are not capable of cooling a standard hotel pan of food quickly enough to comply with these regulations. Although food can be chilled rapidly enough using expensive chilling equipment such as high-capacity blast coolers with high-velocity airflow, such equipment can cost $20,000 or more. As a result, most restaurants and food service operations are forced to use more labor, time, and space intensive methods such as dividing the food into smaller or thinner portions and placing the food into shallow pans, continuously stirring food in a container placed in an ice water bath, using chilled paddles to stir the food, or adding ice as an ingredient.

All of these prior art methods suffer from a number of disadvantages. Blast coolers are expensive and typically require extensive maintenance. Dividing the food into thin layers is labor intensive and wastes valuable refrigerated kitchen space. Stirring and or using chilled paddles is also labor intensive and carries an increased risk of introducing contamination into the food or spreading contamination to different pans. Adding ice as an ingredient dilutes the flavor and consistency of the food. And finally, various studies have shown that most of these methods are simply ineffective in chilling prepared food as rapidly as required by the regulations.

Thus, there is still a need for an improved method of rapidly cooling prepared food from cooking temperatures down to 40° F. or below.

SUMMARY OF THE INVENTION

It is an object of the invention, therefore, to provide a method of rapidly cooling prepared food from cooking temperatures down to 40° F. or below, which is cost effective and easy for restaurant staff to operate and maintain.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF PREFERRED EMBODIMENTS

In a preferred embodiment, the unit uses a novel combination of cold fluid recirculation and vibration to rapidly cool prepared food in a manner that is cost-effective and easy to practice. Although soft foods (for example, cooked vegetables) and foods with a higher water content (for example, soups or sauces) will be affected more by the vibration, the present invention is still effective for dense foods like a roast or other meat dish.

Figure 1:
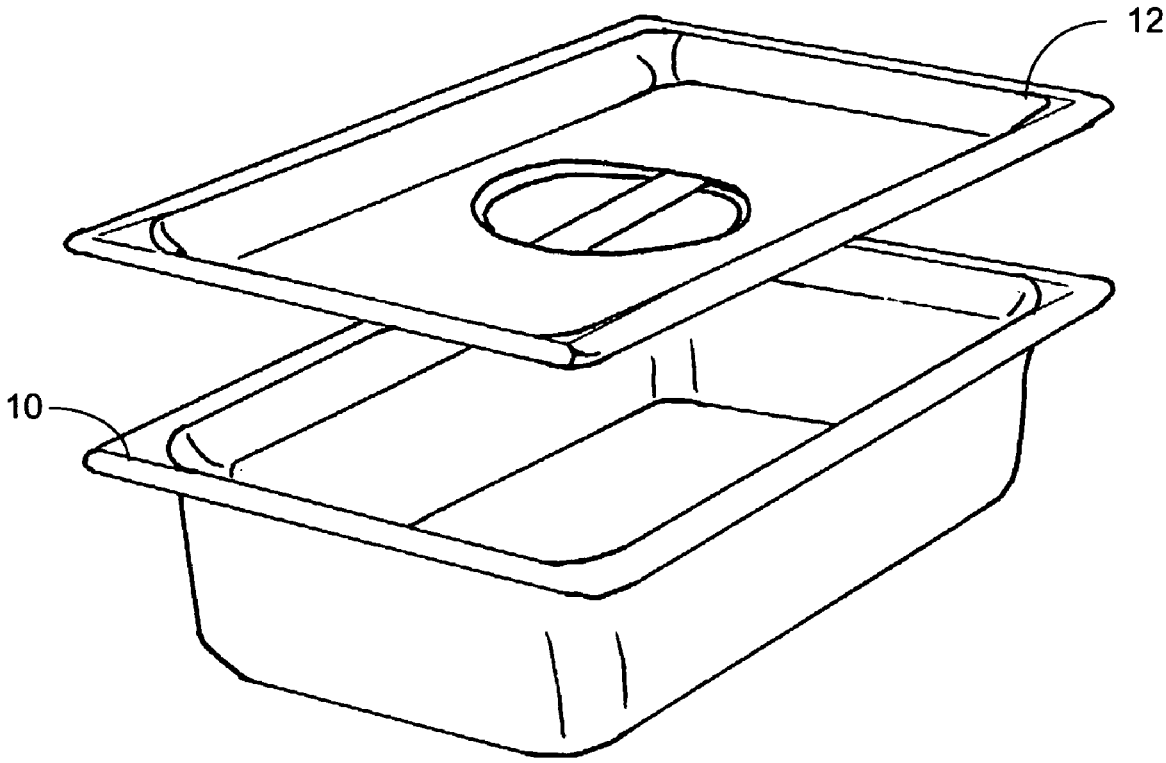
FIG. 1 Prior Art
FIG. 1 is a perspective drawing of a standard hotel food pan and lid.
Figure 2:
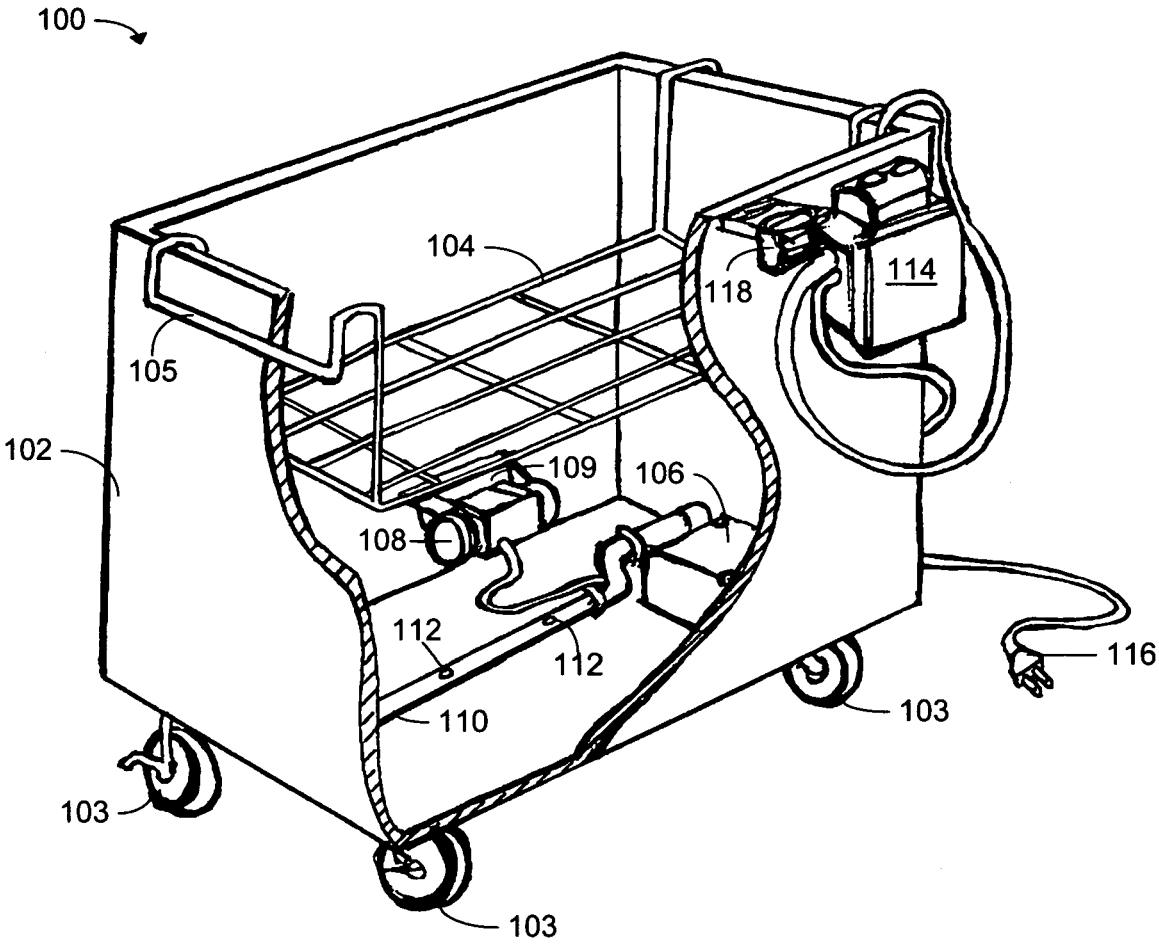
FIG. 2 is a perspective and partial cut-away view of an embodiment of a food chiller according to the present invention.

In the embodiment illustrated in FIG. 2, the cooling unit 100 comprises a stainless steel tank 102. Although the tank is preferably made of stainless steel, it could be formed from any readily cleanable material suitable for water and ice storage. The tank may be insulated with a conventional foam, fiberglass, or other suitable insulator, and it can be fitted with a lid (which can also be insulated). The tank can rest directly on the floor preferably with a layer of intervening insulation or the tank can be supported off the floor with a plurality of legs. Preferably, tank 102 will also have a drain located on the bottom of the tank (not shown) and casters 103 to allow the tank to be easily moved.

The water and ice mixture used to fill the tank can simply be the tap water available at a given site, however it is preferred that the water be potable. Depending on tap water quality, purification systems or water softening systems may be employed to facilitate cleaning and minimize deposition (e.g., minimize hard water deposits). Distilled or filtered water may also be used. Known non-toxic additives can be used to facilitate cleaning or to inhibit mildew, mold, fungus or bacterial growth. For example, the water can be chlorinated. Non-toxic additives that affect freezing point of the water can be added, for example propylene glycol, but are not required.

Preferably, a tank is used which is large enough to hold approximately 9 gallons of ice water for every fluid gallon of food to be cooled. For example, to cool 5 fluid gallons of food (soup, chili, beans, etc.) it would be preferable to use a 45-gallon tank. Skilled persons will recognize that different water to food ratios will affect the cooling rate. Other cooling fluids could also be used instead of water which have different desirable fluid to food ratios.

Figure 3:
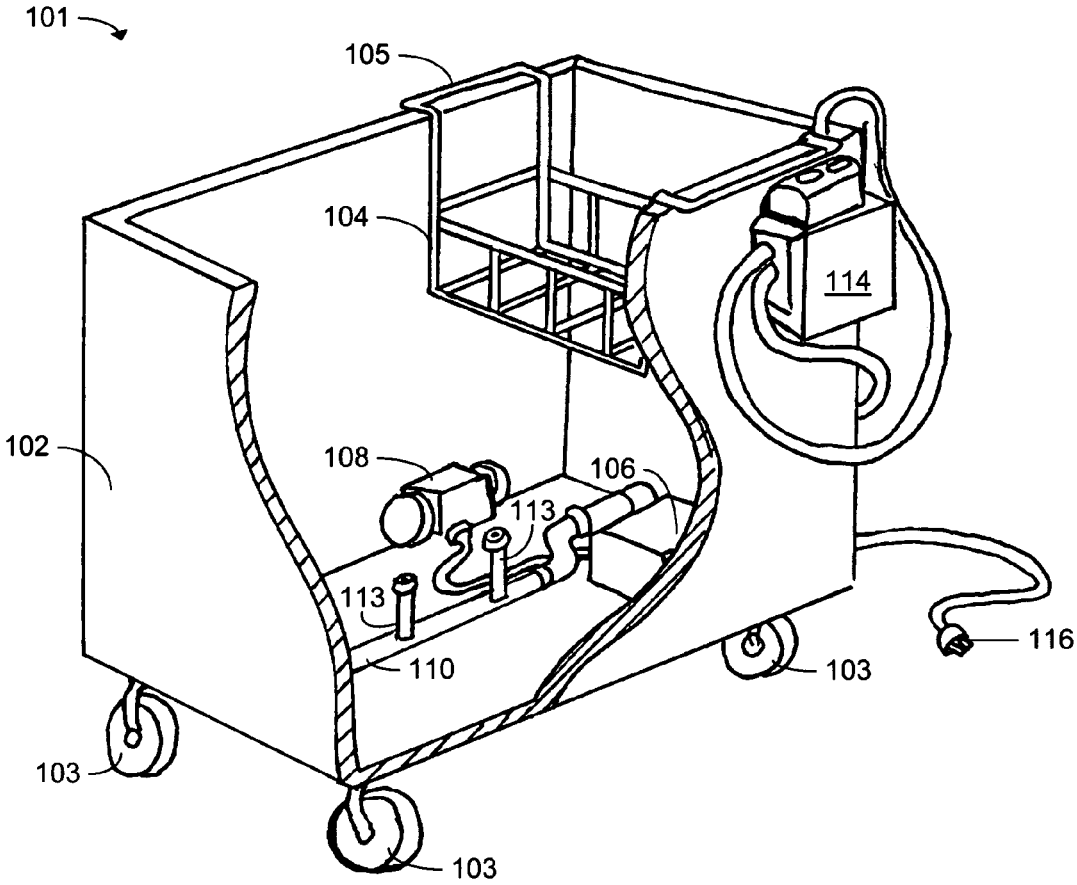
FIG. 3 is a perspective and partial cut-away view of another embodiment of a food chiller according to the present invention.

In a preferred embodiment, one or more holding baskets 104 are mounted in tank 102. Holding baskets 104 are preferably sized so that they can hold standard restaurant food pans or hotel pans. FIG. 2 shows one holding basket 104 extending lengthwise across tank 102 and held in place by handles 105 which hook over the ends of tank 102. According to this embodiment, one or more food pans could be placed side-by-side within holding basket 104. FIG. 3 shows another preferred embodiment of the present invention in which multiple holding baskets 104 are mounted within tank 102 with each basket held in place by handles 105 which hook over the sides of tank 102. According to this embodiment, one food pan would preferably be placed within each holding basket.

Preferably, holding baskets should be sized so that they will hold any standard sized food pan used in the food services industry and formed so as to allow water flow through the baskets. In the preferred embodiment of FIG. 2 and FIG. 3, holding baskets 104 are formed from wire.

As shown in FIG. 2, in a preferred embodiment of the present invention, vibrating device 108 is mounted in the tank by way of mounting bracket and rubber gasket 109 so that the entire contents of the tank (both cooling fluid and food) can be vibrated. For a 45 gallon tank and around 5 fluid gallons of food, the vibrating device will preferably be operated at 7.5-8 force pounds and at a frequency of approximately 50 Hz. For most foods, vibration at lower force (for example, lower than 5 force pounds) and lower frequency (for example, 25 to 50 Hz) will be effective, but may not cause the food to cool quickly enough. Soft foods (such as cut up corn or potatoes) will tend to break down when vibrated with greater force (for example, greater than 10 force pounds) or higher frequencies (for example, greater than 60 Hz). Very dense foods (for example, a roast) can be cooled somewhat faster when vibrated with greater force or higher frequencies (for example 60 Hz and up to 50 force pounds). However, there is a diminishing return as the force and frequency are increased above the above-discussed optimal levels.

Different types of known vibrating devices can be employed, including a tuning fork-type device or an electric vibrator 108 employing an unbalanced electrical motor as illustrated in FIG. 2. Preferably, vibrating device 108 is wired into control unit 114 so that vibrating device 108 can be easily turned on and off. The temperature of the cooling fluid can be monitored with thermometer 118.

As also shown in FIG. 2, in some embodiments of the present invention, a submersible pump 106 is also mounted in tank 102 so that fluid in the tank can be pumped from the bottom of the tank to the top, allowing the fluid to recirculate through holding baskets 104 and around the outer surfaces of the food pans. Any suitable pump may be used to circulate the fluid. For example, in the embodiments of FIG. 2 and FIG. 3, submersible pump 106 is a 1/15th horsepower submersible pump. Water can be pumped, for example, through ½ inch PVC tubing 110 through jets 112. Risers 113 (shown in FIG. 3) can also be used to improve water flow up to the surface. In this way the cold water is constantly moved from the bottom of the tank to the top. Submersible pump 106 is also preferably wired into control unit 114 so that the pump and vibrating unit can both be easily turned on and off.

Figure 4:
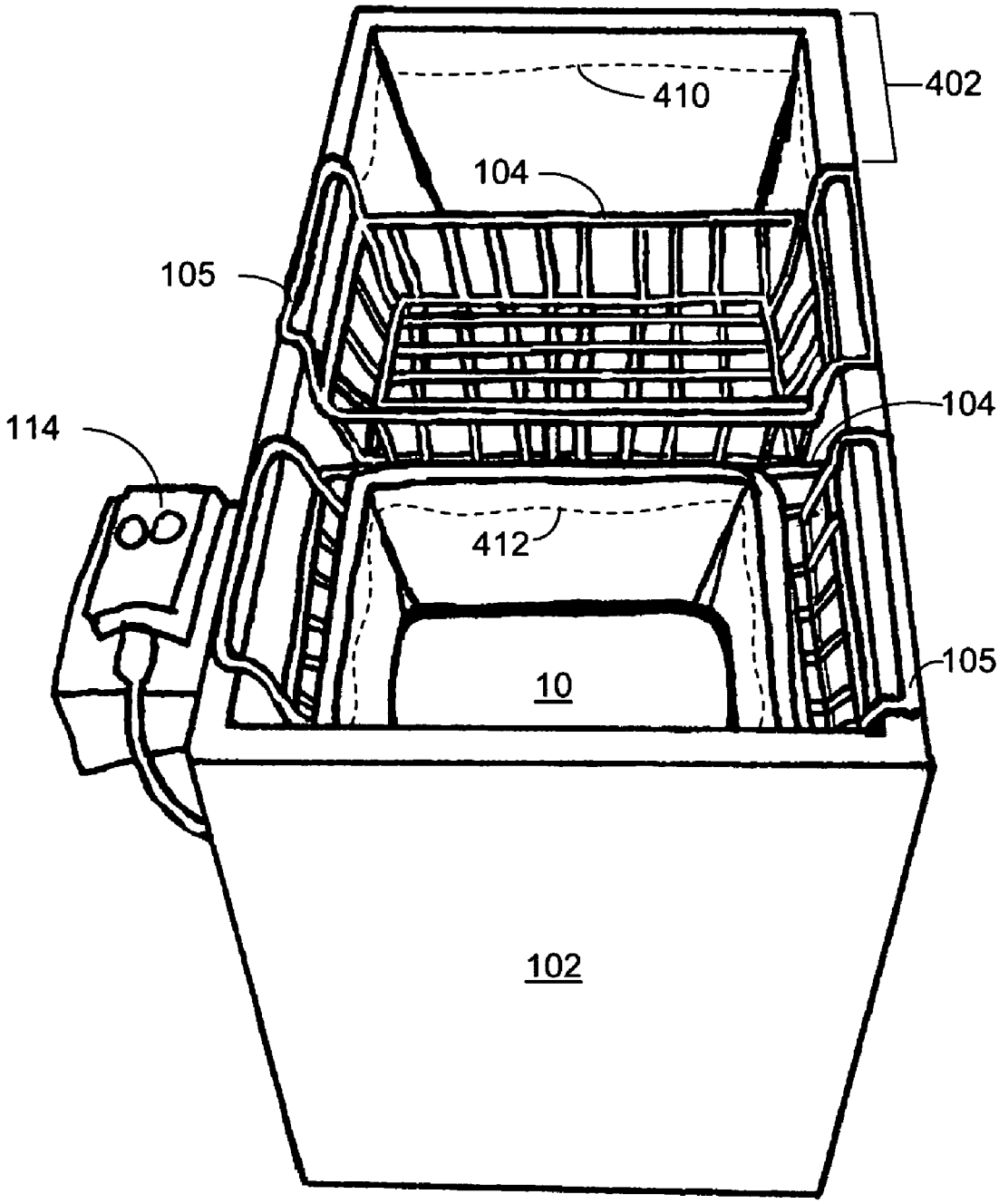
FIG. 4 is a top-down perspective view of an embodiment of a food chiller according to the present invention.

To operate the preferred embodiments illustrated in FIG. 2 and FIG. 3, a mixture of ice and water is added to the tank, filling the tank to a level covering holding baskets 104. FIG. 4 shows a top down perspective view of the embodiment of FIG. 3. One or more pans of hot prepared food (typically at a temperature of 185 to 140 degrees) are then placed in the holding baskets. The tops of the pans should be above water but the rest of the pans (bottom and sides) preferably will be under the water level in the basket. For a 45 gallon tank, approximately 80 pounds of ice should be placed in the tank and then water added to bring the ice water to the desired level.

In FIG. 4, one food pan 10 has been placed in the first holding basket 104A. The second holding basket 104B is empty but could be filled by one full size hotel pan or multiple smaller pans. A third basket (not shown) could be placed in the open area identified by the bracket and reference number 402. Dashed line 410 shows a preferred level for the ice water or other cooling fluid on the inside of tank 102. Dashed line 412 shows the location of this preferred level on the outside of food pan 10, with the ice water covering most of the sides of the food pan but not rising to the top of the pan. Skilled persons will recognize that the most effective cooling will take place by covering as much of the exterior of the pan as possible. However, the cooling fluid level should not be so high that food within the pan could be contaminated or diluted by fluid spilling into the interior of the pan. Alternatively, lids or covers for the food pans could be used to lessen the dangers of contamination or dilution.

Once the cooling fluid and the food pans containing prepared food are in place, both submersible pump 106 and vibrating device 108 are preferably activated. Submersible pump 106 is used to draw cold water from the bottom of the tank and circulate the water through the holding baskets and around the outside of the food pans. In this manner, the cold water draws heat away from the pan. Warmer water (around the hot food pans) is constantly replaced by cooler water (from the bottom of the tank) making the cooling process much more efficient.

At the same time, the fluid in the tank (both ice water and food) is vibrated by vibrating unit 108. This vibration serves to agitate the food so that the molecules in the food continue to move and dissipate energy. In this way, the heat from the food is transferred more efficiently to the pan (which is then cooled by the circulating ice water).

In some situations, the combination of vibration and ice water (or another cooling fluid alone) may be sufficient to adequately cool some types of prepared food without using a pump to circulate the ice water. However, more rapid cooling will usually be accomplished by the combination of vibration and water circulation.

The preferred embodiments shown in FIG. 2 and FIG. 3 are capable of cooling food significantly faster than required by many current health regulations and the recommendations of the FDA and NSF. Tests have shown that foods of varying consistencies and composition in 6" pans with an average food thickness of 4-4.5" could all be cooled from 184° F. down to 40° F. in a maximum of three hours. Most foods reached 40° F. in less than two hours; some foods took as little as 20 minutes.

In contrast to the prior art which typically requires that prepared food be separated into multiple pans with thin layers, preferred embodiments of the present invention are capable of rapidly cooling food even when standard 6 inch pans are filled with the prepared food. As skilled persons will recognize, using the present invention, deeper pans actually allow more pan surface area to come in contact with the ice water or other cooling fluid. Because the food does not have to be divided into multiple shallower pans, labor is minimized and fewer dishes are used. Thus cleanup is also minimized and less valuable kitchen space is occupied.

Preferred embodiments of the present invention also reduce the risks of cross-contamination because no stirrers of cooling paddles come in contact with the food. Nevertheless, in some circumstances, stirring the food, either by hand or by way of a mechanical stirring device, could be employed along with the vibration and water circulation of the present invention where it is necessary to cool the food even faster. Alternatively, mechanical means could be employed to rock the pans during cooling to speed up the process without the increased cleanup and contamination risks associated with physically stirring the prepared food.

Figure 5:
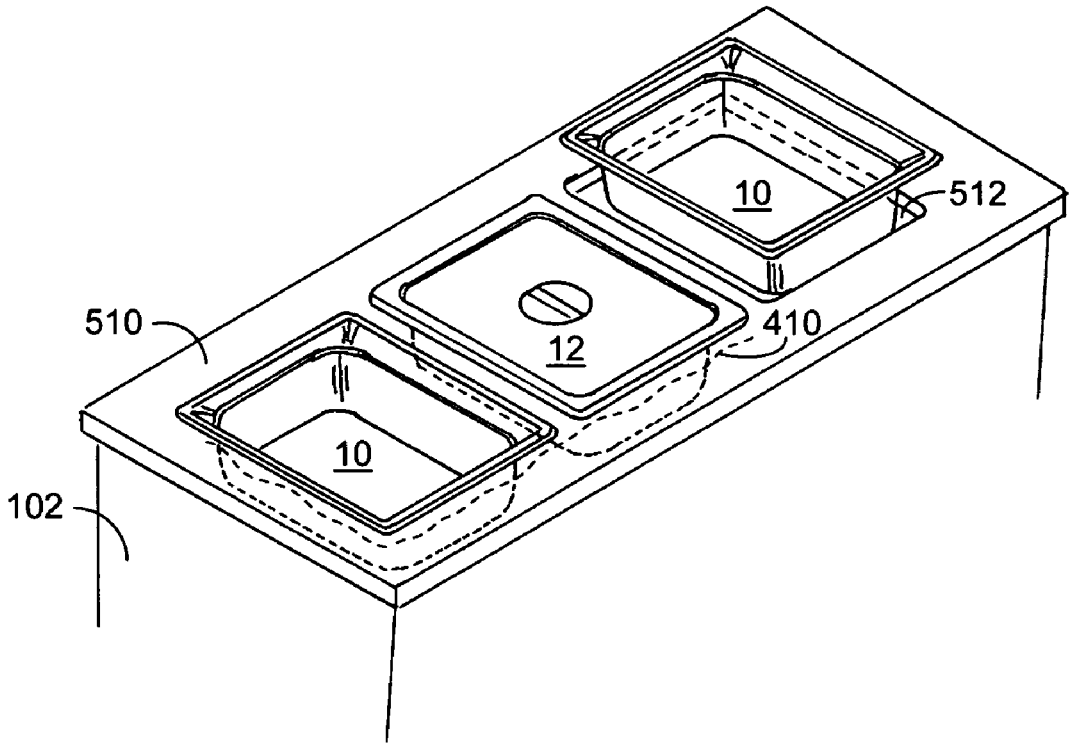
FIG. 5 is a perspective view of a tank lid with multiple pan cut-outs according to an embodiment of the present invention.

FIG. 5 shows another preferred embodiment of the present invention in which tank 102 is covered with a tank lid 510. Instead of the holding baskets discussed above, tank lid 510 has one or more openings or holes 512 shaped to receive the food pans 10 and hold them in place. The holes in the tank lid 502 engage the flanges of the food pans so that the bottoms and sides of the food pans are immersed in the ice water within the tank. In this embodiment, a greater volume of ice water or other cooling fluid will typically be added to the tank than in the embodiments discussed above, because pans mounted through a tank lid will sit somewhat high than pans placed in the holding baskets. Alternatively, deeper pans could be used to achieve the same result.

Figure 6:
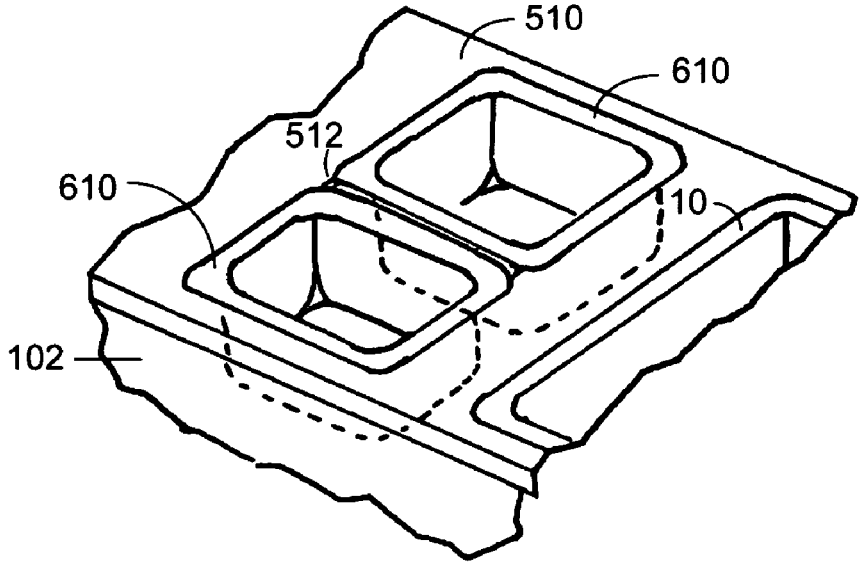
FIG. 6 is a perspective view of a portion of a tank lid according to an embodiment of the present invention with two half pans mounted in a pan cut-outs.

The holes 512 in the tank lid 510 will preferably of a standard size so that standard food pans will fit the openings. In a preferred embodiment, each hole will fit a standard hotel pan or multiple smaller pans (for example, two half pans or four quarter pans). FIG. 6 shows a portion of a tank lid according to the preferred embodiment where two half pans are mounted within a standard sized hole 512. As is known in the art, one or more adapter bars can also be used to divide the holes 512 to fit any desired smaller sized pans.

Alternatively, deeper non-standard pans could also be used having a depth that is substantially greater than the length or width of the pan (for example, quarter size pans with a depth of 12 inches or more). In this fashion, the sides of the pan could be extended deeper into the water or other cooling fluid, thus increasing the surface area of the pan in contact with the cooling fluid while keeping the overall "thickness" of the food within the pan (in this case defined by the length or width of the pan) relatively thin so that the food inside can still be rapidly chilled. For example, allowing for the thickness of the lid and the flange on top of the pan, a 12" pan could extend as deep as 10 inches or more into the cooling fluid. Alternatively, pans that are deeper but also narrower than typical pans could be used. For example, in a preferred embodiment pans could be used having dimensions (W×L×D) of 2-3"×18"×18". Prepared food to be rapidly chilled could be placed in these pans to a depth of 14-16". As skilled persons will recognize, a tank lid could be adapted to have a large number of separate holes shaped to fit this type of non-standard pans or multiple non-standard pans could be mounted in each of the standard sized tank lid holes shown in FIG. 5 and FIG. 6.

This application describes multiple aspects of an improved food chiller. The invention has broad applicability and can provide many benefits as described and shown in the examples above. The embodiments will vary greatly depending upon the specific application, and not every embodiment will provide all of the benefits and meet all of the objectives that are achievable by the invention. A preferred method or apparatus of the present invention has many novel aspects, and because the invention can be embodied in different methods or apparatuses for different purposes, not every aspect need be present in every embodiment. Moreover, many of the aspects of the described embodiments may be separately patentable.

Although the present invention and its advantages have been described in detail, it should be understood that various changes, substitutions and alterations can be made to the embodiments described herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

We claim:

1. A device for chilling food products to a desired temperature comprising:

a tank suitable for holding a volume of cooling fluid, said cooling fluid having a temperature at or below said desired temperature;

a support for supporting one or more food containers substantially within the tank so that when said volume of cooling fluid is added to the tank, the food containers will be surrounded on the exterior sides and bottom by the cooling fluid;

a vibrator for vibrating the cooling fluid and any food containers placed within the tank;

and a fluid pump for drawing cooling fluid from the bottom of the tank and for circulating the cooling fluid around the outside of any food containers placed within the tank;

wherein said food products can be cooled from a temperature of 140 degrees to a temperature of 41 degrees or less within 6 hours.

2. The device of claim 1 wherein said support comprises one or more wire baskets for holding said food containers.

3. The device of claim 1 further wherein said support comprises a tank lid having one or more openings through said tank lid and wherein said food containers are supported by lowering one or more food containers having a horizontal lip through the openings, so that the horizontal lip of the food container is supported by the top surface of the tank lid and the bottom and sides of the container extend into the tank below the lid.

4. The device of claim 1 wherein said desired volume of cooling fluid comprises at least 9 gallons of cooling fluid for every fluid gallon of food products to be cooled.

5. The device of claim 1 wherein the wire baskets are sized so the baskets can hold standard restaurant food pans.

6. The device of claim 1 wherein the vibrator operates at 5 to 10 force pounds.

7. The device of claim 1 wherein the vibrator operates at 7.5 to 8 force pounds.

8. The device of claim 1 wherein said food products can be cooled from a temperature of 140 degrees to a temperature of 70 degrees in two hours or less.

9. The device of claim 1 wherein said food products can be cooled from a temperature of 180 degrees to a temperature of 41 degrees or less within 3 hours.

10. A method of rapidly chilling prepared food products to a desired temperature, the method comprising:

adding a volume of cooling fluid to a tank, said cooling fluid having a temperature at or below said desired temperature;

placing one or more food containers containing prepared food within the tank so that the food containers are surrounded on the exterior sides and bottom by the cooling fluid;

circulating the cooling fluid around the outside of the food containers by pumping cooling fluid from the bottom of the tank to the top of the tank;

while the cooling fluid is circulating, vibrating the cooling fluid and the prepared food at a force greater than 5 force pounds and a frequency greater than 25 Hz.

11. The method of claim 10 wherein placing one or more food containers containing prepared food within the tank comprises placing one or more standard restaurant food pans inside one or more wire baskets within said tank.

12. The method of claim 10 wherein placing one or more food containers containing prepared food within the tank comprises lowering one or more restaurant food pans, said pans having a top horizontal flange, through an opening in a tank lid so that the lower surface of the flange is supported by the top surface of the tank lid and the bottom and sides of the food pan extend into cooling fluid contained within the tank.

13. The method of claim 12 wherein said bottom and sides of the food pan extend 10 inches or more into said cooling fluid.

14. The method of claim 10 wherein adding a volume of cooling fluid to a tank comprises adding a volume of a mixture of ice and water.

15. The method of claim 14 wherein adding a volume of cooling fluid to a tank comprises adding at least 9 gallons of cooling fluid for every fluid gallon of food products to be chilled.

16. The method of claim 10 wherein said food products are cooled to a temperature of 41 degrees or less within 6 hours.

17. A device for chilling food products to a desired temperature comprising:

a tank suitable for holding a volume of cooling fluid, said cooling fluid having a temperature at or below said desired temperature;

means for mounting one or more food containers substantially within the tank so that when said volume of cooling fluid is added to the tank, the food containers will be surrounded on the exterior sides and bottom by the cooling fluid; and a vibrator for vibrating the cooling fluid and any food containers placed within the tank, the vibrator comprising a tuning fork-type device or an electric vibrator employing an unbalanced electrical motor.

* * * * *